United States Patent [19]

Mazman

[11] 3,953,025

[45] Apr. 27, 1976

[54] MUSCLE BUILDING EXERCISE DEVICE

[76] Inventor: Martin S. Mazman, 1251 N. Fancher Ave., Fresno, Calif. 93712

[22] Filed: Mar. 25, 1971

[21] Appl. No.: 127,870

Related U.S. Application Data

[63] Continuation-in-part of Ser. No. 767,247, Oct. 14, 1968, abandoned.

[52] U.S. Cl. ..... 272/132; 272/DIG. 5; 272/58

[51] Int. Cl.[2] ..... A63B 23/04; A63B 23/00; A63B 21/20; A63B 21/22

[58] Field of Search ..... 272/79 R, DIG. 3, DIG. 5, 272/82, 83 A, 80, 70, 58, 79 D; 188/72.8; 81/62; 74/575

[56] References Cited

UNITED STATES PATENTS

| | | | |
|---|---|---|---|
| 726,012 | 4/1903 | Andrew | 81/62 |
| 2,783,044 | 2/1957 | Sbarra | 272/72 X |
| 3,103,357 | 9/1963 | Berne | 272/58 X |
| 3,315,959 | 4/1967 | Carnielli | 272/72 |
| 3,357,522 | 12/1967 | Bradley et al. | 188/72.8 |
| 3,528,653 | 9/1970 | Stuckenschneider et al. | 272/72 |
| 3,572,699 | 5/1969 | Nies | 272/73 |

*Primary Examiner*—Richard C. Pinkham
*Assistant Examiner*—William R. Browne
*Attorney, Agent, or Firm*—Vergil L. Gerard

[57] ABSTRACT

In this preferred embodiment of a muscle building exercise device a disc is rotatably mounted in a frame in operative association with brake pads which resist its rotation. The brake pads consist of a pair of plates mounted in the frame, one on each side of the disc, which have surfaces containing friction material disposed in engagement with the face of the disc. The plates can be adjusted to tighten their engagement with the disc and thus increase the braking resistance to its rotation. The disc has rachet teeth in its periphery and is driven rotatably by a pair of lever arms which are pivotally mounted in the frame at one end and have a handle on the other. The lever arms carry a pawl which engages the rachet teeth and drives the disc when the lever arms are pivoted in one direction but passes over the rachet teeth when the lever arms are pivoted in the other direction.

13 Claims, 16 Drawing Figures

INVENTOR
MARTIN S. MAZMAN
BY
Vergil F. Gerard
ATTORNEY

INVENTOR
MARTIN S. MAZMAN
BY Vergil L. Gerard
ATTORNEY

MARTIN S. MAZMAN
INVENTOR

Virgil L. Gerard
ATTORNEYS

MARTIN S. MAZMAN
INVENTOR

Virgil L. Gerard
ATTORNEYS

MUSCLE BUILDING EXERCISE DEVICE

This application is a continuation-in-part of application Ser. No. 767,247 filed by applicant on Oct. 14, 1968, now abandoned, and entitled MUSCLE BUILDING EXERCISE DEVICE.

BACKGROUND OF THE INVENTION

This invention relates generally to body building and exercising devices and more particularly to devices for building body muscles where the resistance is provided by means other than weights.

As our society has become more mechanized fewer jobs require arduous physical effort. As a result, physical conditioning and muscle building activities have become increasingly popular, as sports and hobbies. In general, these activities divide themselves into two classes: Those performed for the purpose of maintaining muscle tone and good body condition, and those of a considerably more rigorous nature performed to build more powerful muscles and for competition. For many years weight lifting has been the favorite means used by those pursuing this latter class of activity, and as a result, a great variety of devices to assist in its practice have been developed.

Weight lifting equipment originally consisted of bar bells upon which weights of selected amounts could be assembled. However, more recently, weight lifting devices of greater sophistication have come into use. An important example of this are devices which hold a stack of weights in assembly and permit a selected number to be lifted by means of a cable or lever arm. These devices have enjoyed great acceptance because they eliminate the safety hazard and inconvenience of loose weights and barbells. These new devices still present some hazard from falling weights, however, and have the same disadvantages of restricted portability and excessive bulk experienced with the older apparatus.

Resistance devices other than weights have been used in exercising apparatus but these devices have not been suited to use in muscle building activities because of expense and complexity or their inability to withstand the substantial forces involved.

A need, therefore, exists for a resistance mechanism in a muscle building exercise device which eliminates the use of weights and yet is sufficiently simple and rugged to find acceptance.

It is, therefore, a major object of my invention to provide a muscle building exercise device with a resistance mechanism other than weights.

It is also an important object of my invention to provide a muscle building exercise device of the type described which is sufficiently rugged to withstand the force necessarily present in weight lifting activities and is still sufficiently inexpensive to manufacture and simple to operate to achieve commercial acceptance.

It is a further object of my invention to provide a muscle building exercise device of the type described in which the resistance mechanism can be utilized with different actuating means to numerous variations in the exercises performed.

It is yet another object of my invention to provide a device of the type described which is more readily portable, less bulky, and less hazardous than prior known devices for performing such activities.

It is yet a further object of my invention to provide a a muscle building exercixe device of the type described in which resistance is incurred when the users move the device in one direction but it may be moved freely in the opposite direction.

These and other objects and advantages of my invention will become more readily apparent from the following detailed description of preferred embodiments and the accompanying drawings in which.

Figure 2:
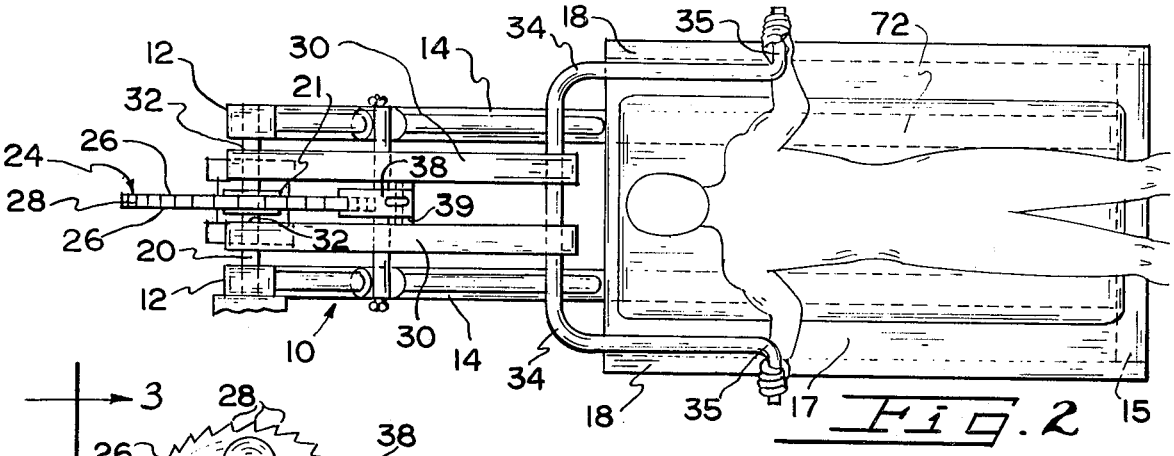
FIG. 2 is a plan view of a preferred embodiment shown in FIG. 1.
Figure 1:
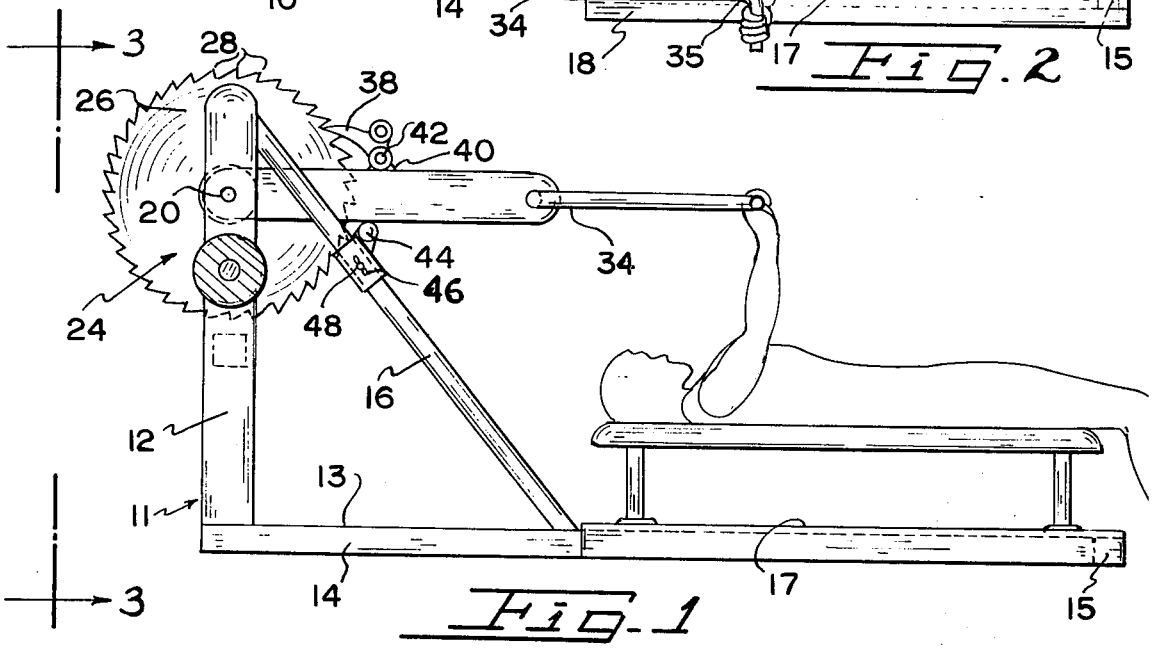
FIG. 1 is a side elevational view of a preferred embodiment of my invention.
Figure 3:
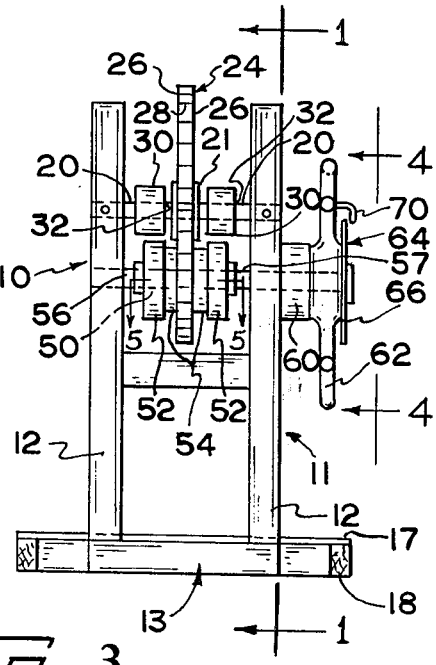
FIG. 3 is an end elevational view taken at 3—3 in FIG. 1.
Figure 4:
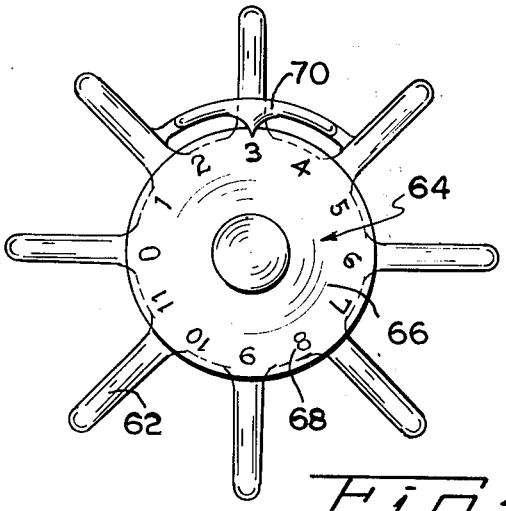
FIG. 4 is a partial side elevational view showing the resistance indicator, taken at 4—4 in FIG. 3.

Referring now to the drawings and particularly FIG. 1-3 thereof, the numeral 10 designates generally a muscle building exercise device incorporating my invention. The muscle building exercise device 10 has a frame 11 formed of two upright stanchions 12 disposed in parallel, spaced relationship on a base 13. The base 13 is formed of two elongated members 14 with cross-members 15 welded to their forward and rearward ends. The stanchions 12 are welded to the rearward end of the base 13 and are supported by a pair of brace members 16 which extend diagonally between the upper portions of the stanchions 12 and the base 13 in a forward disposition. The brace members 16 are welded to the stanchions 12 at their upper ends and to the elongated members 14 at their lower ends. A platform 17 having side legs 18 is positioned over the elongated members 14 forwardly of the stanchions 12 and extends over the forward cross-member 15.

An axle 20 is mounted between the upper portions of the stanchions 12 in a generally horizontal position and affixed to each of the stanchions. A relatively large metal disc 24 is rotatably mounted on axle 20 by means of a bearing 21 which permits axial as well as rotational movement of disc 24 with respect to the axle 20 for reasons which will later become apparent. The disc has solid faces 26 which connect its hub and periphery, and a band of relatively rugged rachet teeth 28 mounted on its periphery. The rachet teeth 28 extend from the periphery of the disc in a somewhat tangential direction for reasons hereafter made apparent.

A pair of lever arms 30 are pivotally mounted at their proximal ends on the axle 20, one on each side of the disc 24, by means of bearings 32. The bearings 32 provide free movement of the lever arms with respect to the axle 20. The bearings 32 are spaced outwardly a short distance on each side of the disc 27 to avoid interference with axial movement of the disc. The lever arms 30 extend forwardly of the stanchions 12 in a generally horizontal position and have a handlebar 34 affixed to their distal ends. The handlebar 34 is generally U-shaped with hand grips 35 extending outwardly from and normal to the ends of each leg of the U.

For interconnection between the lever arms 30 and the disc 24, a pawl 38 is provided which is pivotally mounted on pivot block 39 positioned between the lever arms 30 by means of a pair of parallel upstanding ears 40 and a pivot pin 42. The pivot block 39 is positioned near the periphery of th disc 24 and the pawl 38 extends rearwardly and upwardly therefrom into tangential engagement with the rachet teeth 28.

To support the lever arms 30 in a useful position, support bar 44 extends horizontally between the brace members 16 and beneath the lever arms. The support bar 44 is attached to the brace members 16 by means of sleeves 46 mounted on each end of the support bar. The sleeves 46 slide on the brace members 16 and have lock screws 48 which releaseably secure them in place.

Figure 5:
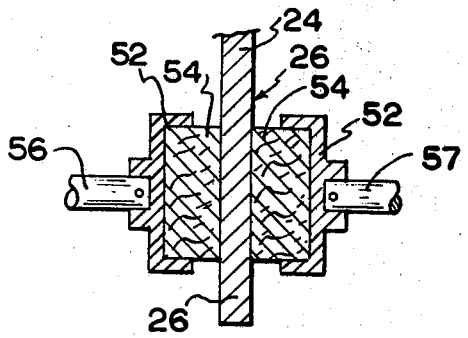
FIG. 5 is an enlarged partial sectional view taken on line 5—5 in FIG. 3.

To brake the rotation of the disc 24, a spot brake 50 is provided (see FIGS. 3 and 5). The spot brake 50 consists of a pair of plates 52 mounted, one on each side, of the disc 24. Each of the plates 52 has a pad 54 of friction material, such as brake lining, on its inwardly facing surface disposed to engage the face surfaces 26 of the disc 24. The plates 52 are mounted, one to each of the stanchions 12, by means of two mounting shafts 56 and 57. The mounting shaft 56 is fixedly mounted in one of the stanchions 12 and extends inwardly to support the pad 52 mounted thereon in position to engage one face of the disc 24. The mounting shaft 57 has threads on a portion of its periphery an is threadedly mounted in the other upright stanchion 12 for inward and outward movement with respect to the disc 24. The disc 24 is axially movable on the axle 20 as previously mentioned and pressure applied against one side of the disc by the inward movement of shaft 57 will shift the disc axially on the axle 20 to equalize the pressure between the pair of plates 52. On the outer end of the shaft 56 is a coupling block 60 mounted on the outside of its stanchion 12. A torque lever 62 is coupled through the coupling block 60 to the shaft 57 and has a torque indicator 64 which indicates the torque applied to the shaft 57 by the torque lever. The torque indicator 64 has a face plate 66 with calibrations 68 thereon and a pointer 70 which moves with respect to the calibrations. The calibrations 68 are arranged to translate the torque applied to the shaft 57 by the torque lever into equivalent pounds of barbell weight at the handlebars 34.

A body support 72 is provided on the base 13 and disposed to support the body of a user in a prone position below the handlebars (see FIGS. 1 and 2).

To operate my muscle building device 10, the user lies back down on the body support 72 with his head directed toward the disc 24 and his hands holding the grips 35 of the handlebar 34 (see FIG. 1). The handlebar 34 is held a sufficient distance above the body support 72 by the support bar 44 to permit entry of the user's body and yet close enough to the user's body, when it is disposed on the body support, to allow a substantial distance of upward movement of the handlebar by extension of the user's arms. The proper positioning of the support bar 44 is achieved by adjusting the sleeves 46 on the brace members 16. He then forces the handlebar 34 upwardly away from his body by extension of his arms, causing the lever arms 30 to pivot upwardly about their pivotal connections with the axle 20. As the lever arms 30 pivot upwardly, the pawl 38 on the pivot block 39 engages the rachet teeth 28 on the periphery of the disc 24 causing the disc to be driven in rotation on the axle 20 (counter-clockwise as seen in FIG. 2).

The spot brake 50 is adjusted by means of threading the shaft 57 in its stanchion 12 to cause frictional engagement of pads 54 with the faces 26 of the disc 24. Adjustment of the spot brake 50 by threading the shaft 57 with the torque lever 62 inwardly in the stanchion 12 brings the pads 54 into equal frictional contact with the adjacent faces 26 of the disc, since the disc 24 moves axially on the axle 20. Operating through coupling block 60, the torque lever 62 is tightened to a point where the torque indicator 64 indicates, by means of the positioning of the pointer 70 on the calibrations 68, a resistance position of the desired equivalent of barbell weight.

When the user has fully extended his arms, against the resistance of the spot brake 50 operating on the rotating disc 24, he reverses his efforts and draws the handlebar 34 downwardly, again toward his body. As the handlebar 34 is drawn downwardly, the pawl 38 is released from engagement with the rachet teeth 28 on the periphery of the disc 24 and drags freely over the teeth permitting the lever arms 30 to pivot downwardly into supporting engagement with the support bar 44 without rotating the disc 24.

With the lever arms 30 again supported on the support bar 44, the user repeats the extension of his arms, driving the handlebar 34 and the lever arms 30 upwardly again and thus causing engagement of the pawl 38 with the rachet teeth 28 which again drives the disc 24 against the resistance of the spot brake 50. This activity is continued the desired number of times by the user, who on each occasion of extending his arms, must expend the effort necessary to drive the disc 24 against the resistance of the spot brake 50. If, after a given number of cycles, the user desires to increase or decrease the euqivalent barbell weight at the handlebar 34, he makes an appropriate adjustment of the spot brake by means of the torque lever 62.

ALTERNATE USES

Figure 6:
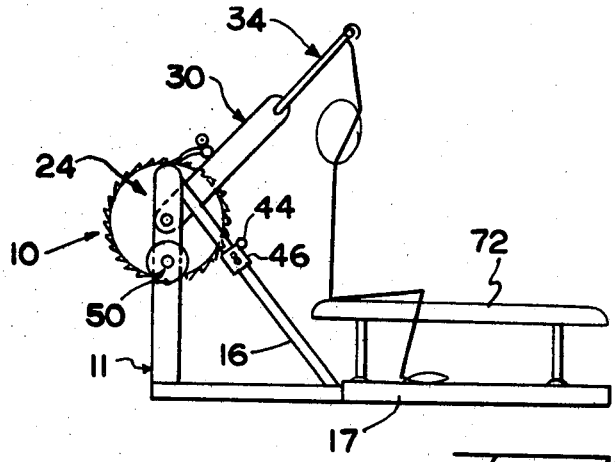
FIGS. 6 through 9 are elevational illustrations of some of the different muscle building exercises which can be performed on this embodiment of my invention.

As illustrated by FIGS. 6 through 9, it is possible to utilize my muscle building exercise device 10 in a great variety of other body building activities. As shown in FIG. 6, my muscle building exercise device 10 may be used for a shoulder press by placing the lever arms 30 and the handlebar 34 above the user's head while the user sits straddle of the body support 72 with his back toward the disc 24. The user then extends his arms to drive disc 24 against the resistance of the spot brake 50 ad retracts his arms, drawing the handlebar 34 freely downward.

Figure 7:
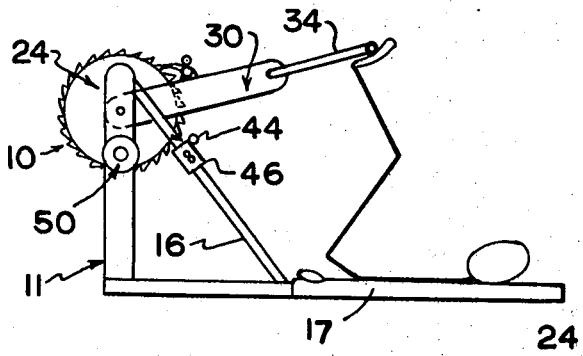

FIG. 7 illustrates my muscle building exercise device 10 being used for a leg press. For this exercise the body support 72 is removed and the user lies on his back on the platform 17 with his legs facing the disc 24 and his feet on the handlebar 34. The user then extends his legs to drive the disc 24 against the resistance of the spot brake 50 and then lowers his legs to permit the handlebar 34 to drop freely downward.

Figure 8:
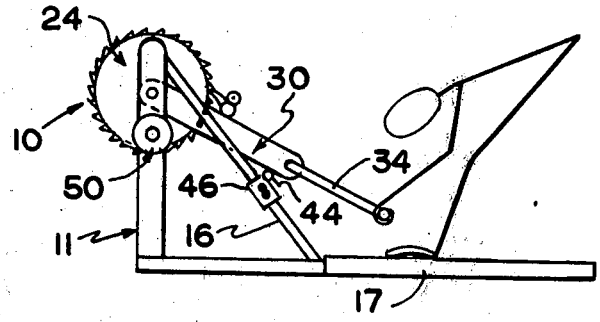

FIG. 8 illustrates the use of my muscle building exercise device 10 in a dead lift exercise. Here the support bar 44 is lowered by releasing the lock screws 48 and moving the sleeves 46 downward on the brace member 16. The handlebar 34 is then permitted to drop to about the level of the platform 17 and the user lifts the handlebar from this position, causing rotation of the disc 24 against the resistance of the spot brake 50. When the lift has been completed the handlebar is moved freely downward again.

Figure 9:
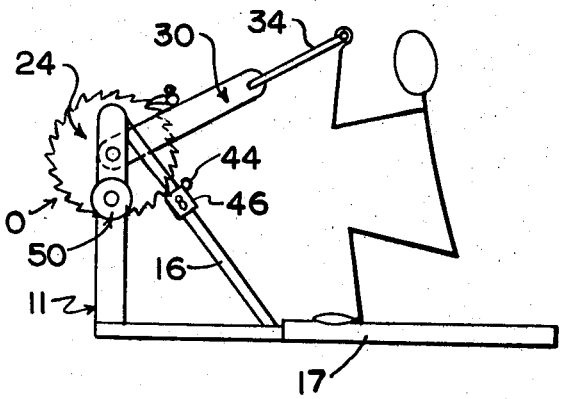
Figure 10:
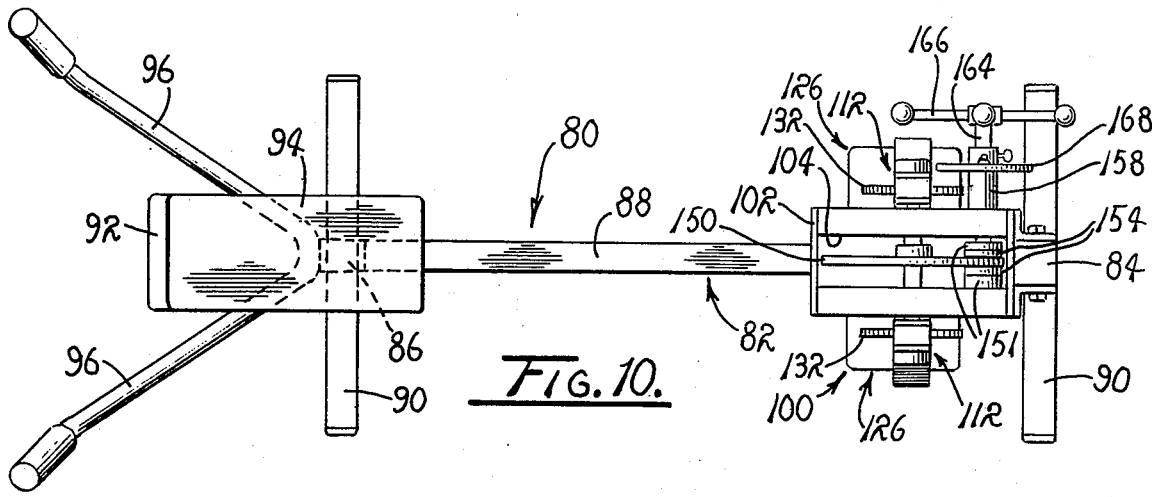
FIG. 10 is a plan view of a second embodiment of my invention.

FIG. 9 illustrates my muscle building exercise device 10 being used to perform a squat lift. Here the support bar 44 is returned to an upper position on the brace members 16 and the user squats before the handlebar 34 facing the disc 24. Holding the handlebar 34 just above his head, the user then extends his legs and arms, driving the disc 24 against the resistance of the spot brake 50 and then squats again, drawing the handlebar freely downward.

SECOND EMBODIMENT

Figure 11:
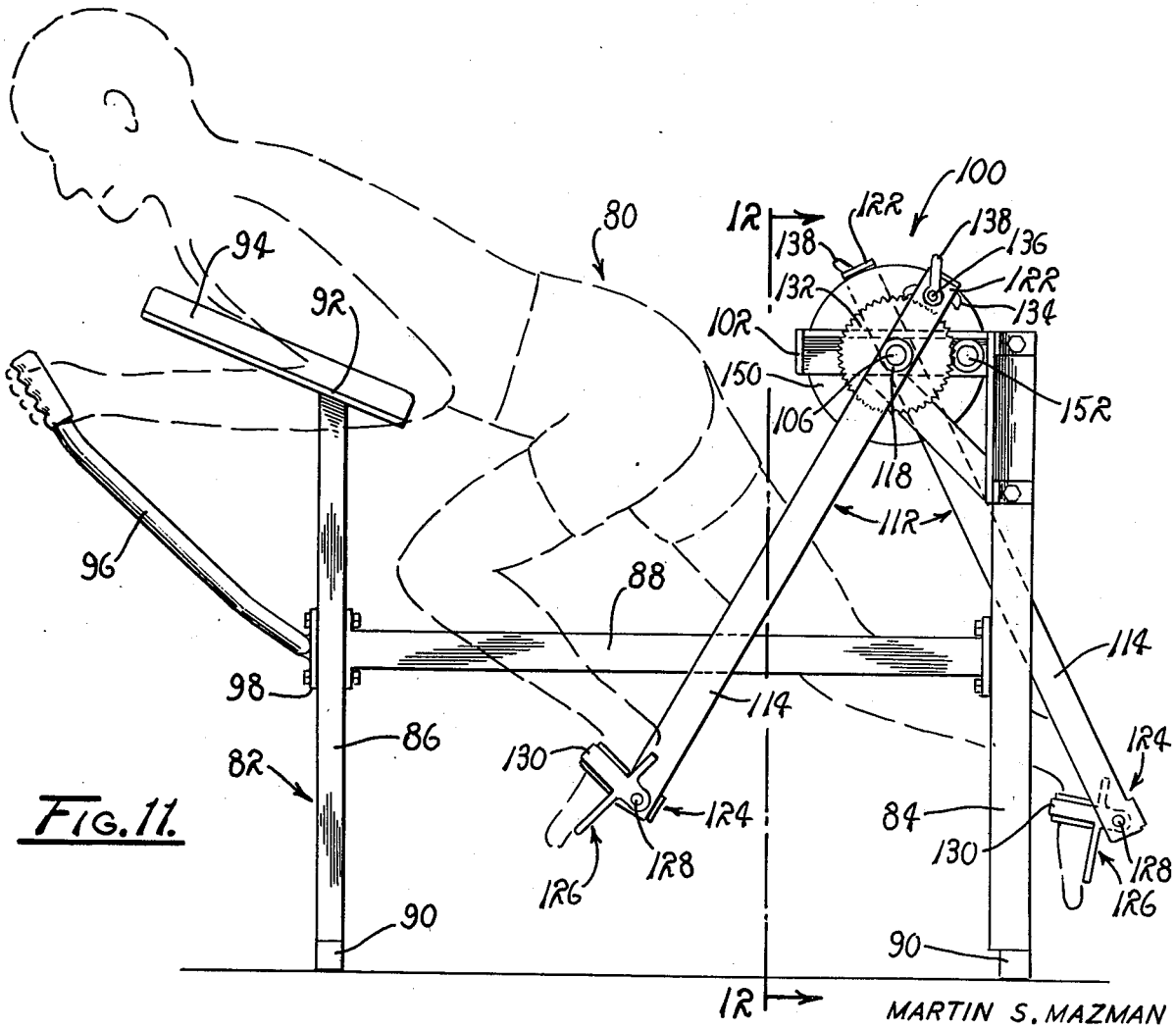
FIG. 11 is a side elevational view of the second embodiment shown in FIG. 10.
Figure 12:
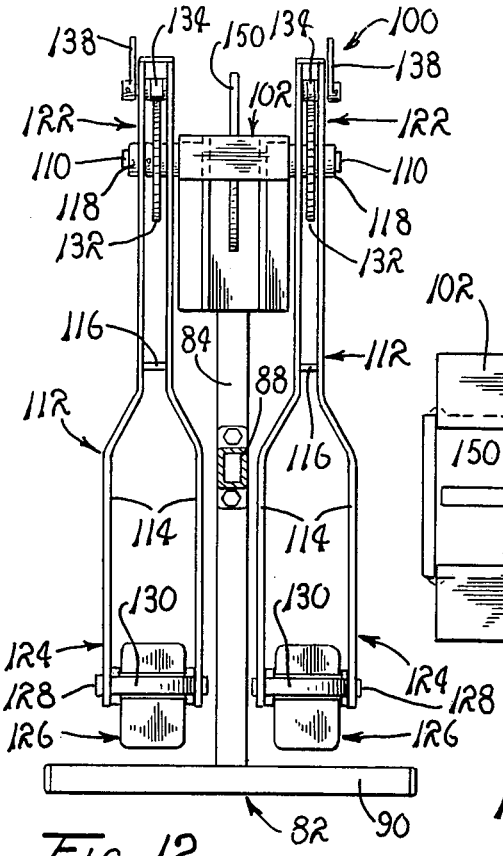
FIG. 12 is a cross-sectional elevational view of the second embodiment of my invention taken at 12—12 in FIG. 11.
Figure 13:
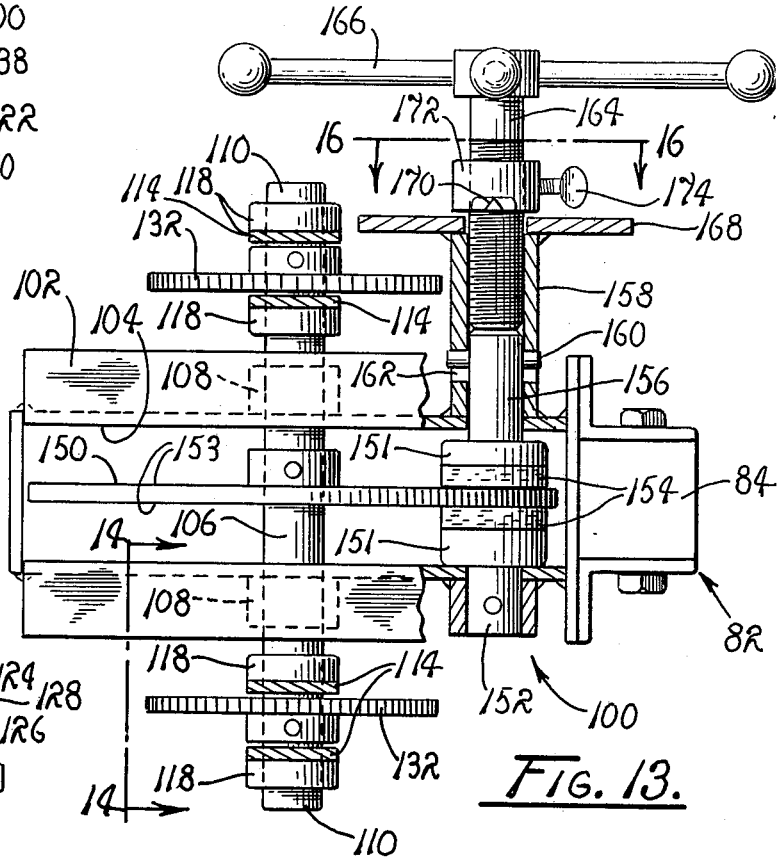
FIG. 13 is a partial plan view of the second embodiment of my invention.
Figure 16:
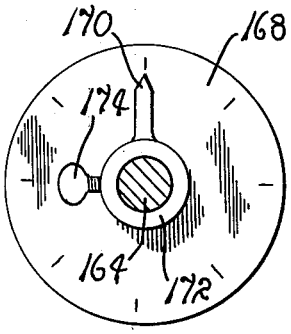
FIG. 16 is a partial cross-sectional elevational view taken at 16—16 in FIG. 13, and showing the resistance force indicator.
Figure 14:
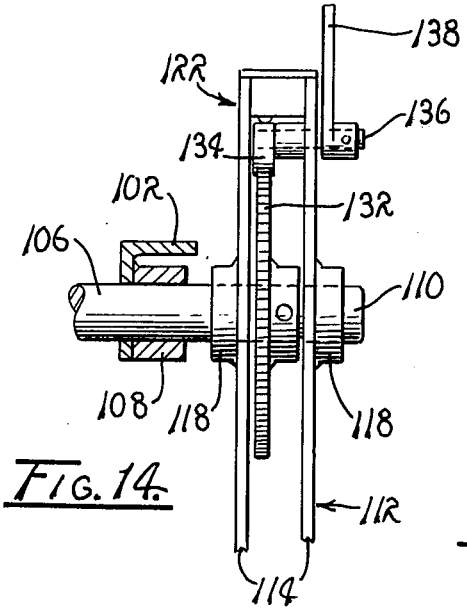
FIG. 14 is a partial cross-sectional elevational view of my second embodiment taken at 14—14 in FIG. 13.

In FIGS. 10 through 16 I show a second embodiment of my invention, adapted primarily for the muscle building exercise of the limbs. In this embodiment the numeral 80 designates the muscle building exercise device, generally. The muscle building device 80 has a frame 82 which is formed of two upright stanchions, a forward stanchion 84 and a rearward stanchion 86, connected by a longitudinal connector bar 88. Each of the stanchions has a crossbar 90 at its lower end, which extends laterally outward on each side of the stanchion and serves as a stabilizing foot. A body rest 92 is affixed to the top of the rear stanchion 86 and tilted slightly toward the forward stanchion 84. The top of the body rest 92 has padding 94 so that the body of the user can be supported in various positions, one of which is shown in FIG. 11. Handlebars 96 are also mounted on the rearward stanchion 86 by a bracket 98 which can be loosened for adjustment of the position of the handle bars. As best shown in FIG. 11, the handlebars 96 help stabilize the body of the user during some types of exercises.

A resistance mechanism 100 is mounted on the upper portion of the forward stanchion 84. The resistance mechanism 100 has a support frame 102 which is affixed to the top of the forward stanchion 84 and projects rearwardly therefrom toward the rearward stanchion 86. The support frame 102 is generally rectangular in shape with a center opening 104. A shaft 106 is rotatably mounted on the support frame 102 by bearings 108 and is positioned laterally with respect to the frame 80 (see FIG. 13). The outer ends 110 of the shaft 106 project outwardly on each side of the support frame 102 and a lever arm 112 is pivotally mounted on each of these outer ends. The lever arms 112 are each formed of two strap members 114 connected in generally parallel relationship by cross straps 116. Lever arm journal bearings 118 are mounted in each of the strap members 114 near their upper ends 122 and the shaft 106 passes through these bearings to pivotally mount the lever arms. The upper ends 122 of each of the lever arms 112 extend a short distance beyond the lever arm bearings 118, for reasons which will later become apparent. The lower ends 124 of each of the lever arms 112 extend downwardly from the lever arm bearings 118 and carry pedals 126. To more readily accommodate the pedals 126, the strap members 114 of each lever arm 112 are bowed apart intermediate their ends to provide a wider separation between their lower ends 124 (see FIG. 12). At the lower ends of each of the lever arms 112, a pedal shaft 128 is mounted between the two strap members 114 of each lever arm, and the pedals 126 are pivotally mounted on these pedal shafts. By mounting the pedals 126 between the strap members 114 the user's foot is retained from sliding off the pedal sidewise, and toe straps 130 are provided on the pedals to further aid in holding the user's foot on the pedals.

Between each pair of lever arm bearings 118 of each lever arm 112, a rachet gear 132 is affixed to the shaft 106. The rachet gears 132 are engaged by multi-teeth pawls 134 mounted in the upper ends 122 of each of the lever arms 112 (see FIGS. 14 and 15).

Figure 15:
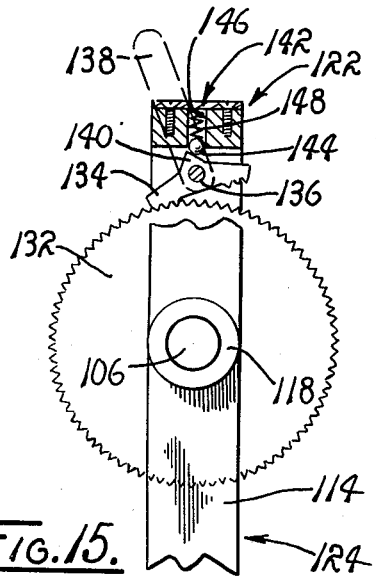
FIG. 15 is a partial side elevational view of the resistance drive mechanism in my second embodiment.

The multi-teeth pawls 134 are mounted in the upper ends of each lever arm 112 by means of a pawls stub shaft 136 which is movable with respect to the lever arm. On the inner end of each of the pawl stub shafts 136, a pawl positioning handle 138 is affixed to the shaft so that the pawl 134 can be pivotally moved with respect to the lever arm. As best shown in FIG. 15, the multi-teeth pawls 134 each have three teeth in their forward end and three teeth in their rearward end, and a pawl position cam 140 projecting upwardly at their center. The pawl positioning cam 140 is engaged by a pawl positioning lock 142 consisting of a ball 144 mounted in a recess 146 in the uppermost cross strap 116 and resiliently urged into engagement with the pawl positioning cam 140 by a spring 148. The pawl positioning lock 142 engages the pawl positioning cam in a manner which holds the pawl in either a forwardly tilted position or a rearwardly tilted position. This holding action of the pawl positioning lock 142 can be overcome by manual operation of the pawl positioning handle 118, however, to tilt the pawl 134 to its alternate position.

In either its forwardly tilting position or its rearwardly tilting position, the pawl 134 engages the teeth at that respective end with the peripheral teeth of the rachet gear 132. If the pawl 134 is tilted rearwardly so that its rearward teeth engage the rachet gear 134, pivotal movement of the lever arm 112, to which the pawl is attached, will drive its associated rachet gear 132 when the upper end 122 of the lever arm moves rearwardly, and the lower end 124 forwardly, conversely, the pawl will float or drag over the rachet gear teeth when the upper end 122 moves forwardly, and the lower end 124 rearwardly. The pawls 134 thus connect each of the lever arms 112 to their associated rachet gear 132 for uni-directional driving movement. Reversal of the tilting direction of the pawls 134 will reverse the direction of this uni-directional driving.

At the center of the shaft 106, and in the center opening 104, a disc 150 is mounted on and affixed to the shaft. The shaft 106 is movable axially in the bearings 108 for reasons hereafter made apparent, and space is allowed between the shaft mounted apparatus such as disc 150 to permit this axial movement.

The disc 150, therefore, rotates with the shaft 106, and a pair of braking plates 151 are provided at the forward end of the support frame 102 to resist the rotation of the disc. The braking plate 151 on one side of the disc 150 is fixedly mounted in the support frame 102 by means of a fixed braking plate shaft 152. The fixed braking plate 151 is positioned in the support frame 102 with the braking plate 151 projecting into the center opening 104 juxtaposed on one of the faces 153 of the disc 150 and adjacent its periphery. A friction pad 154 is mounted on each of the braking plates 151 and positioned for friction engagement with the juxtaposed face 153 of disc 150.

The braking plate 151 on the other side of the disc 150 is movably mounted in the support frame 102 by means of a movable breaking plate shaft 156. The movable braking plate shaft 156 is mounted in a sleeve 158 affixed to the support frame 102, and is slidable axially within this sleeve. To prevent rotation of the movable braking plate shaft 156 within the sleeve 158, a projecting pin 160 is mounted in the shaft and projects radially therefrom on each side into oppositely disposed pin slots 162 provided in the sleeve 158. The braking plate 151 on the movable braking plate shaft 156 is juxtaposed the other face 153 of the disc 150 adjacent the periphery thereof, and has a friction pad 154 mounted thereon which frictionally engages the disc.

To adjust the movable braking plate shaft 156 in the sleeve 158, a threaded adjustment bolt 164 is threadedly mounted in the outer end of the sleeve 158 and axially engages the outer end of the movable braking plate shaft 156. The adjustment bolt 164 has a turn handle 166 on its outermost end by which it can be manually threaded into or out of the sleeve 158. Any pressure placed on the disc by engagement of the braking plates will, of course, be exercised equally since the disc shifts axially on the shaft 106 to assure this.

To indicate the relative position of the adjustment bolt 164 in the sleeve 158, and thereby reveal the amount of pressure between the braking plates 151 and the disc 150, an indicator dial 168 is mounted on the outer end of the sleeve 158, and a pointer 170 is releasably affixed to the outer end of the adjustment bolt 164. The pointer 170 has a center hub 172 with a radial set screw 174 which permits adjustment of the pointer rotatably with respect to the adjustment bolt. This rotatable adjustment between the pointer 170 and the adjustment bolt 164 allows the pointer to be set at zero on the indicator dial 168 for initial frictional engagement between the disc 150 and the braking plates 151 and the desired resistance inserted by tightening the adjustment bolt from there.

To operate the second embodiment of my invention, the user positions himself rearwardly with his chest on the body rest 92, grips the handlebars 96, and places his feet on the pedals 126 with his toes under the straps 130. He then pumps his legs, alternately driving the lever arms 112 forward and rearward (see FIG. 11). As the lever arms 112 move forwardly, pivoting about the shaft 106 on bearings 108, the upper ends 122 of these lever arms move rearwardly and, assuming the pawls 134 are positioned with their rearward teeth downward in contact with the peripheral teeth of the ratchet gears 132, the pawls will engage the ratchet gears and drive them rotationally, thereby rotating the shaft 106 and disc 150. The pair of braking plates 151 being disposed to engage the faces 153 of the disc 150 near its periphery, will resist the rotation of the disc, forcing the user to exert considerable effort in moving the lever arms.

When the lever arms 112 are moved rearwardly, assuming the pawls 134 are positioned with their rearward teeth downward, as stated above, the upper ends 122 of the lever arms will move forwardly and the pawls will drag over the peripheral teeth of the ratchet gears 132 without engaging and rotating the gears. In this action the shaft 106 and disc 150 will not be rotated and no substantial effort will be required by the used to move the lever arms.

If the user desires greater resistance to movement of the lever arms 112 forwardly, he need only tighten the adjustment bolt 164 by means of the turn handle 166. This will move the pointer 170 with respect to the indicator dial 168 indicating the new resistance setting. To keep the resistance settings on the indicator dial 168 sustantially constant with respect to the resistance actually resulting from a particular setting, even after wear has occurred in the friction pads 154, the user need only tighten the adjustment bolt 164 to point where the braking plates 151 first contact the faces 153 of the disc, and with the resistance mechanism in this condition, set the pointer to zero indication on the indicator dial. The pointer 170 is reset by merely loosening the set screw 174, moving the pointer and tightening the set screw again. Thereafter, the adjustment bolt can be further tightened to bring the pointer 170 to any desired setting on the indicator dial 168, and resistance to movement of the lever arms will then be experienced in the expected amount.

As previously mentioned, the frictional resistance applied to the disc 150 upon its rotation by the braking plates 151 will be applied equally by each braking plate because the disc is axially movable on the shaft 106 and will equalize the applied pressure.

If the user desires to reverse the direction of resistance to movement of the lever arms 112, he merely changes the positions of the pawls 134 by moving the pawl positioning handles 138 to pivot the pawls so that their forward teeth, rather than their rearward teeth contact the peripheral teeth of the rachet gears 132. Once so moved the pawls will be held in this new position by action of the spring loaded balls 144 on the pawl positioning cams 140.

With the pawls in this new position, substantial resistance to movement of the lever arms 112 will only be experienced upon rearward movement, and their forward movement will meet with substantially no resistance. This change occurs, of course, since the pawls, in their new position, will only engage the rachet gears and drive the disc when the lever arms are moved rearwardly, and will drag over the peripheral teeth of the rachet gears when the lever arms are moved forwardly.

Since each of the pawls 134 are separately controlled with respect to their pivot position, it is also possible to arrange the pawls so that one of the lever arms 112 resists forward movement but not rearward movement, while the other resists rearward movement but not forward movement.

It is obvious also that many different exercises other than those described are possible with my device. For example, the user can face forwardly, supporting himself on the body rest, and drive the lever arms with his legs from this position. Also, the lever arms can be raised to chest level and operated by the users arms with the user facing either forwardly or rearwardly. Any, other exercise positions to numerous to mention can be utilized including many of those mentioned with respect to my first embodiment, the principal difference being that in my second embodiment the user has two driving members (lever arms) to move rather than one, and they can be moved independently of one another or together.

From this description of preferred embodiments of my invention and their alternative methods of use it will be understood that I have provided a very useful muscle building device which avoids the necessity of weights and at the same time incorporates all their advantages in body building exercises. It will also be understood that my minor modifications a great variety of body exercises are possible utilizing my invention.

While it is recognized that other braking arrangements could be utilized, the spot brake type resistance mechanism provides a simple, yet effective, braking means for the disc, which, by reason of its being laterally offset from the axis of the disc, permits ample resistance for any conceivable exercise to be obtained. It is also recognized that my one way drive might be done differently. The pawl and rachet gear has the substantial advantages of dependability, strength and simplicity needed in this type device.

The structure disclosed attains the objects and provides the advantages heretofore described, it being inexpensive to build and simple to use, and yet sufficiently sturdy to withstand the necessary forces. Also, the one way drive permits activities which incorporate the advantages of both isometric exercises and weight liting. That is, the muscles are first stressed, in the movement against the resistance, as in weight lifting, and then relaxed, in the free return movement, thus providing the alternate stress and release cycle utilized in the isometric exercises.

I claim:

1. A muscle building exercise device comprising:

a frame having a pair of spaced parallel frame arms;

brake means connected to said frame for resisting the force exerted by a user, said brake means including action means for responding to force exerted by a user, said action means having a unitary axle defining a central axis and mounted between said frame arms and a brake member mounted on said axle and said brake member being movable with respect to said frame arms both rotatably about said central axis and axially therealong and said brake member having a pair of oppositely disposed face surfaces substantially normal to said central axis, and said brake means further including a pair of braking plates each connected to said frame, each of said braking plates having a brake member engaging surface and each engaging surface having an area substantially less than one-half the area of one of said brake member face surfaces and positioned juxtaposed a different one of said face surfaces for frictional engagement therewith at a spot thereon radially offset from said central axis, said braking plates having mutually aligned axes and being positioned in said frame to engage each of said face surfaces with their mutually aligned axes radially offset from said central axis;

user input means operatively associated with said frame and movable with respect thereto so as to transfer energy exerted by a user during an exercise program, said user input means having a lever arm with a proximal end connected to said axle and pivotally movable with respect to said axle and about said central axis and said lever arm having a distal end with user contact means thereon for receiving the force exerted by a user;

and connecting means for drivingly interconnecting said user input means and said brake means so as to transfer the force asserted by a user from said user input means to said brake means, said connecting means including rachet gear means integrated with said action means into a unitary structure and pivotally mounted pawl means connected to said user input means lever arm, said pawl means being disposed to engage said rachet gear means and rotatably drive said brake member upon movement of said user input means lever arm in a first direction and to disengage from and pass over said rachet gear means upon movement of said user input means lever arm in a second direction.

2. A muscle building exercise device as described in claim 1, in which:

one of said braking plates of said brake means having a mounting shaft disposed in a bore in one of said frame arms and movable axially therein and drive means for moving said braking plate mounting shaft in said bore, said drive means being interconnected with said bore and said mounting shaft and being manually operable to drive said braking plate axially with respect to its respective frame arm to adjust the frictional engagement between said braking plates and said brake member and cause said brake member to move axially along said central axis to equalize the frictional engagement applied upon said brake member by said braking plates.

3. A muscle building exercise device as described in claim 2, in which:

said axle of said brake means has its ends extending beyond said frame arms;

said user input means include a pair of lever arms each having a distal end with user contact means thereon for transferring energy exerted by a user to said lever arm and a proximal end mounted on a different one of the ends of said axle and pivotally movable with respect thereto; and said rachet gear means of said connecting means includes rachet gears connected to each of said ends of said axle adjacent a different one of said proximal ends of lever arms, and said pawl means of said connecting means includes a pawl connected to each of the proximal ends of said lever arms adjacent to and positioned to engage said adjacent rachet gear.

4. A muscle building exercise device as described in claim 1, in which:

said brake member of said brake means is a disc, and is mounted on said axle and movable rotatably thereabout and axially therealong; and said rachet gear means of said connecting means includes radially projecting rachet gear teeth in the periphery of said disc.

5. A muscle building exercise device as described in claim 1, in which:

said user input means lever arm includes a bifurcated proximal end pivotally mounted on said axle with said brake member disposed between said bifurcated portions;

said axle of said action means is fixedly mounted in said frame arms and said brake member is a disc and is movable with respect to said axle both rotatably and axially; and said rachet gear means of said connecting means includes rachet gear teeth on the periphery of said disc and said pivotally mounted pawl means of said connecting means is mounted on said lever arm adjacent said bifurcated portions adjacent to and positioned to engage said rachet gear teeth on said brake member.

6. A muscle building exercise device as described in claim 1, in which:

said pawl means of said connecting means includes a pawl shaft pivotally mounted in said proximal end of said lever arm adjacent said rachet gear means, an arcuate pawl member fixedly mounted on said pawl shaft adjacent its center with its ends each directed arcuately toward said rachet gear means and having pawl teeth thereon, and a pawl lever interconnected with said pawl member and operable to pivotally move said pawl member between a first position wherein said pawl teeth at a first end of said pawl member engage said rachet gear means and the pawl teeth at the second end are disengaged therefrom, and a second position wherein said pawl teeth at said second end of said pawl member engage said rachet gear means and the pawl teeth at said first end are disengaged therefrom, and a releasable locking mechanism operatively associated with said pawl means and disposed to releasably secure said pawl member in a selected one of said positions.

7. A muscle building exercise device as described in claim 1, in which:

said user means lever arm includes a bifurcated proximal end pivotally mounted on said axle with said rachet gear means disposed between said bifurcated portions and said pivotally mounted pawl means mounted on said lever arm adjacent the proximal end thereof.

8. A muscle building exercise device as described in claim 1, in which:

said frame further includes a cross brace between said frame arms disposed to resist spreading apart of the distal ends thereof;

said action means includes said axle being mounted between said frame arms with its axis aligned with said central axis and being movable with respect to said frame and said brake member being mounted centrally on said axle and being connected thereto and rotatable therewith;

said user input means includes a pair of user input members each being mounted on a different end of said axle and having a distal end with user contact means thereon for transferring energy exerted by a user to said user input member and a proximal end mounted on said axle and pivotally movable with respect to said axle; and said rachet gear means of said connection means includes a pair of rachet gears each fixedly mounted on a different end of said axle adjacent the proximal end of one of said user input members; and said pawl means of said connecting means includes a pair of pawls each pivotally mounted on a different one of said user input members adjacent the proximal ends of said pair of user input members and adjacent to and positioned to engage said adjacent rachet gear and rotatably drive said rachet gear, axle and brake member when its respective user input member is pivoted in one direction and to disengage from said rachet gear and pass over said rachet gear teeth without rotatably driving said rachet gear, axle and brake member when its respective user input member is pivoted in the opposite direction, whereby said brake member can be driven rotatably by either of said user input members selectively, and simultaneously by both of said user input members, only in one direction.

9. A muscle building exercise device comprising:

a frame having a base for attaching said frame to a mounting surface, a pair of parallel spaced frame arms each having proximal ends interconnected with said base and distal ends remote therefrom, and a shaft mounted in said frame arms and movable rotatably therein;

a pair of user input members movably mounted on said frame to transfer energy exerted by a user during an exercise program, each of said user input members having a distal end with user contact means thereon for transferring energy from a user to said user input member and a proximal end mounted on said shaft, said user input members each being mounted on a different end of said shaft and being pivotally movable with respect to said shaft;

brake means connected to said frame for resisting the force exerted by a user acting on said user input members, said brake means including a disc mounted on said shaft, centrally thereof and between said frame arms and said user input members, and a pair of braking plates each having a plate mounting means for mounting said plates to a different one of said frame arms and a frictional pad on each plate, said pads being disposed to frictionally engage opposite faces of said disc at a location radially offset from the axis of said shaft, said braking plates being axially aligned and oppositely disposed with respect to one another and one of said braking plates having means to permit said one of said plates to be adjustably movable axially with respect to the frame arm in which it is mounted to adjust the magnitude of its frictional force engagement with said disc whereupon said disc is caused to move axially; and connecting means for drivingly interconnecting said user input means and said brake means, when said plates are in engagement with said disc, so as to transfer the force exerted by a user during an exercise program from said user input means to said brake means, said connecting means including a pair of rachet gears with peripheral teeth thereon, each of said rachet gears being fixedly mounted on a different end of said shaft adjacent the proximal ends of a different one of said user input members and a pair of pawls each pivotally mounted on the proximal end of a different one of said user input members adjacent to and positioned to engage the teeth of said adjacent rachet gear and drivingly rotate said rachet gear, shaft and disc when said respective user input member is pivoted in one direction and to disengage from and pass over said rachet gear teeth without drivingly rotating said rachet gear, shaft and disc when said respective user input member is pivoted in the other direction, whereby said shaft and disc can be driven rotatably by either of said user input members selectively, and simultaneous by both of said user input members, only in one direction.

10. A muscle building exercise device comprising:

a frame having a base attachable to a mounting surface, a pair of elongated spaced parallel frame arms having proximal ends interconnected with said base and distal ends remote therefrom, and an axle fixedly mounted in the distal ends of said frame arms;

a user input member interconnected with said frame to transfer energy to exerted by a user during an exercise program, said user input member having a distal end with user contact means thereon for transferring energy from a user to said user input member and said input member having a bifurcated proximal end with the bifurcated portions mounted on said axle and pivotally movable with respect thereto;

brake means connected to said frame for resisting the force exerted by a user on said user input member, said brake means including a disc mounted on said axle centrally thereof, and between the distal ends of said frame arms and the bifurcated portions of the proximal end of said user input member, said disc having axle mounting means so as to mount said disc on said axle, and said disc being movable with respect to said axle both rotatably and axially, and a pair of braking plates each having a plate mounting means for mounting each plate to one of said arms, each having a friction pad, each said plate being positioned adjacent the distal end of each said arms and each friction pad being disposed to frictionally engage an opposite side of said disc, and said braking plates being disposed in axial alignment with each other on opposite sides of said disc and engaging said disc sides at oppositely disposed spots radially offset from the axis of said axle, and one of said braking plates having means to permit movement thereof by varying physical forces exerted by a user on said one of said plates wherein said movement of said one of said plates is translated to said disc whereupon said disc is caused to shift axially on said axle by the action of said one of said plates for a limited distance before being held against axial movement by said braking plates; and connecting means drivingly interconnecting said user input member and said brake means so as to transfer the force asserted by a user from said user input means to said brake means, said connecting means including radially projecting teeth in the periphery of said disc and a pawl pivotally mounted adjacent the proximal end of said user input member adjacent to and positioned to engage said teeth and drivingly rotate said disc when said user input member is pivoted in a first direction and to disengage from and pass over said teeth without rotating said disc when said user input member is pivoted in the other direction.

11. A muscle building exercise device comprising:

a base having a mounting surface positioned to engage a face on a structure for mounting said device to a structure; a support frame projecting from said base substantially normal to said mounting surface, said support frame having a pair of frame arms with distal ends positioned remote from said base, and cross-tie means interconnected with said frame arms for preventing separation of said frame arms by separating forces applied therebetween;

user input means operatively associated with said frame and movable with respect thereto so as to transfer energy exerted by a user during an exercise program, said user input means including lever arm means for transferring energy exerted by a user during an exercise program, said lever arm means having a distal end with user contact means thereon for transferring energy exerted by a user to said lever arm means, said lever arm means having a proximal end mounted in said frame for pivotal movement about a central axis, whereby said lever arm means is pivotal about said central axis by a user applying force to the distal end of said lever arm means through said user contact means;

brake means interconnected with said support frame for resisting the force exerted by a user during an exercise program, said brake means including action means for responding to the force exerted by a user, said action means having a central axis and being mounted in said support frame between said frame arms, said action means having a brake member movable with respect to said frame arms both rotatably about said central axis and axially therealong, and said brake member having a pair of oppositely disposed face surfaces positioned substantially normal to said central axis, and said brake means further including a pair of oppositely disposed braking plates connected to said frame, each of said braking plates having a brake member engaging surface with an engaging area substantially less than half of the area of a face surface of said brake member and positioned juxtaposed a different one of said face surfaces, for frictional engagement therewith at a spot radially offset from said central axis, said braking plates being mounted one on each of said frame arms and aligned on an axis through a spot on said brake member, parallel to and radially offset from said central axis, said plates clamping said brake member therebetween to cause frictional resistance to the rotational movement thereof, one of said braking plates having means to permit movement thereof by a user to vary the physical forces to be translated to said brake member through said one of said plates and cause said brake member to move axially along said central axis for a limited distance before being held against axial movement by said oppositely disposed braking plate; and connecting means for drivingly interconnecting said user input means and said brake means so as to transfer the force exerted by a user from said user input means to said brake means, said connecting means including rachet gear means integrated with said action means of said brake means to form a unitary structure, rotatable about said central axis, and positioned juxtaposed said proximal end of said lever arm means, and pawl means pivotally mounted on said lever arm means adjacent said rachet gear means and positioned to drivingly engage said rachet gear means and rotate said brake member about said central axis upon pivotal movement of said lever arm in one direction, and to drivingly disengage from and pass over said rachet gear means without moving said brake member upon pivotal movement of said lever arm in the opposite direction.

12. A muscle building exercise device as described in claim 11, in which:

said cross-tie means of said frame includes an axle fixedly mounted in said support frame between said frame arms with its axis aligned with said central axis;

said lever arm means of said user input means is bifurcated at its proximal end to form a pair of outwardly extending legs;

said brake member of said brake means includes a disc mounted on said axle between said frame arms and said legs of said bifurcated proximal end of said lever arm means and movable with respect thereto both rotatably and axially;

said rachet gear means of said connecting means includes radially projecting teeth in the periphery of said disc; and said pivotal pawl means of said connecting means is mounted adjacent the proximal end of said lever arm means and disposed to engage said teeth on said disc.

13. A muscle building exercise device as described in claim 11, in which:

said frame further includes a shaft mounted in said frame arms and movable with respect thereto both rotatably and axially;

said lever arm means of said user input means includes a pair of lever arms interconnected with different ends of said shaft, each having a distal with user contact means thereon for transferring energy from a user to said lever arm and a proximal end mounted on said shaft for pivotal movement with respect thereto;

said brake member of said brake means is mounted on said shaft between said frame arms and rotatably movable with said shaft;

said rachet gear means of said connecting means includes a pair of rachet gears each mounted on a different end of said shaft adjacent the proximal end of a differet one of said user input means lever arms; and said pivotal pawl means of said connecting means includes a pair of pawls each pivotally mounted on the proximal end of a different one of said lever arms adjacent to and positioned to engage a different one of said rachet gears.

* * * * *